US009745996B2

(12) United States Patent
Nurzynski

(10) Patent No.: US 9,745,996 B2
(45) Date of Patent: Aug. 29, 2017

(54) FAN

(75) Inventor: Michal Rafal Nurzynski, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 1031 days.

(21) Appl. No.: 13/991,121

(22) PCT Filed: Oct. 28, 2011

(86) PCT No.: PCT/GB2011/052109
§ 371 (c)(1),
(2), (4) Date: Jul. 17, 2013

(87) PCT Pub. No.: WO2012/072996
PCT Pub. Date: Jun. 7, 2012

(65) Prior Publication Data

US 2013/0302156 A1 Nov. 14, 2013

(30) Foreign Application Priority Data

Dec. 2, 2010 (GB) ..... 1020419.6

(51) Int. Cl.
*F04D 29/38* (2006.01)
*F04D 17/06* (2006.01)
(Continued)

(52) U.S. Cl.
CPC ..... *F04D 29/384* (2013.01); *F04D 17/06* (2013.01); *F04D 29/281* (2013.01); *F04D 29/30* (2013.01)

(58) Field of Classification Search
CPC ..... F04D 17/00; F04D 17/16; F04D 25/08; F04D 29/4226; F04D 29/38;
(Continued)

(56) References Cited

U.S. PATENT DOCUMENTS 1,357,261 A 11/1920 Svoboda
1,767,060 A 6/1930 Ferguson
(Continued)

FOREIGN PATENT DOCUMENTS

AU 201100923 9/2011
BE 560119 8/1957
(Continued)

OTHER PUBLICATIONS

Atkinson, U.S. Office Action mailed Sep. 18, 2015, directed to U.S. Appl. No. 13/743,975; 8 pages.
(Continued)

*Primary Examiner* — Dwayne J White
*Assistant Examiner* — Su Htay
(74) *Attorney, Agent, or Firm* — Morrison & Foerster LLP

(57) ABSTRACT

A fan casing includes an impeller housing, a mixed-flow impeller located within the impeller housing, and a motor for driving the impeller. The impeller includes a hub connected to the motor, and a plurality of blades connected to the hub, each blade comprising a leading edge located adjacent the air inlet of the impeller housing, an inner side edge connected to and extending partially about the outer surface of the hub, an outer side edge located opposite to the inner side edge, and a blade tip located at the intersection of the leading edge and the outer side edge. The leading edge comprises an inner portion located adjacent the hub, and an outer portion located adjacent the blade tip, and wherein the inner portion is swept rearwardly from the hub to the outer portion, and the outer portion is swept forwardly from the inner portion to the blade tip.

16 Claims, 9 Drawing Sheets

(51) Int. Cl.
*F04D 29/30* (2006.01)
*F04D 29/28* (2006.01)

(58) Field of Classification Search
CPC ..... F04D 29/384; F04D 29/388; F04D 29/40; F04D 29/403; F04D 29/281; F04D 29/30; F04D 29/441
USPC ..... 416/188, 223 B, 185, DIG. 2, 183, 238, 416/242
See application file for complete search history.

(56) References Cited

U.S. PATENT DOCUMENTS 1,896,869 A 2/1933 Larsh
2,014,185 A 9/1935 Martin
2,035,733 A 3/1936 Wall
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,336,295 A 12/1943 Reimuller
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,339,867 A 9/1967 Bayless
3,444,817 A 5/1969 Caldwell
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,502,837 A 3/1985 Blair et al.
4,568,243 A 2/1986 Schubert et al.
4,630,475 A 12/1986 Mizoguchi
4,643,351 A 2/1987 Fukamachi et al.
4,653,976 A * 3/1987 Blair ..... F01D 5/045 415/1
4,703,152 A 10/1987 Shih-Chin
4,718,870 A 1/1988 Watts
4,732,539 A 3/1988 Shin-Chin
4,737,077 A * 4/1988 Vera ..... F01D 5/141 416/169 A
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,685,696 A * 11/1997 Zangeneh ..... F04D 29/68 416/186 R
5,730,582 A * 3/1998 Heitmann ..... B63H 11/08 416/185
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,056,518 A 5/2000 Allen et al.
6,065,936 A 5/2000 Shingai et al.
6,073,881 A 6/2000 Chen
6,082,969 A 7/2000 Carroll et al.
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,338,610 B1 1/2002 Harada et al.
6,348,106 B1 2/2002 Embree et al.
6,386,845 B1 5/2002 Bedard
6,454,527 B2 9/2002 Nishiyama et al.
6,480,672 B1 11/2002 Rosenzweig et al.
6,511,288 B1 1/2003 Gatley, Jr.
6,599,088 B2 7/2003 Stagg
D485,895 S 1/2004 Melwani
6,709,236 B1 3/2004 Hoelzer
6,752,711 B1 6/2004 Yeung
6,789,787 B2 9/2004 Stutts
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,186,075 B2 3/2007 Winkler et al.
7,189,053 B2 3/2007 Winkler et al.
7,241,214 B2 7/2007 Sixsmith
7,317,267 B2 1/2008 Schmid et al.
7,455,504 B2 11/2008 Hill et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.

(56) References Cited

U.S. PATENT DOCUMENTS

| | | | | |
|---|---|---|---|---|
| D605,748 | S | 12/2009 | Gammack et al. | |
| 7,664,377 | B2 | 2/2010 | Liao | |
| D614,280 | S | 4/2010 | Dyson et al. | |
| 7,775,848 | B1 | 8/2010 | Auerbach | |
| 7,806,388 | B2 | 10/2010 | Junkel et al. | |
| 7,921,962 | B2 | 4/2011 | Liddell | |
| 8,033,783 | B2 | 10/2011 | Ishikawa et al. | |
| 8,092,166 | B2 | 1/2012 | Nicolas et al. | |
| 8,430,624 | B2 | 4/2013 | Cookson et al. | |
| 8,469,658 | B2 | 6/2013 | Gammack et al. | |
| 2002/0015640 | A1 | 2/2002 | Nishiyama et al. | |
| 2002/0106547 | A1 | 8/2002 | Sugawara et al. | |
| 2003/0059307 | A1 | 3/2003 | Moreno et al. | |
| 2003/0171093 | A1 | 9/2003 | Gumucio Del Pozo | |
| 2003/0228226 | A1* | 12/2003 | Higashimori | F01D 5/04 416/243 |
| 2004/0022631 | A1 | 2/2004 | Birdsell et al. | |
| 2004/0049842 | A1 | 3/2004 | Prehodka | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2005/0069407 | A1 | 3/2005 | Winkler et al. | |
| 2005/0128698 | A1 | 6/2005 | Huang | |
| 2005/0132529 | A1 | 6/2005 | Davidshofer | |
| 2005/0163670 | A1 | 7/2005 | Alleyne et al. | |
| 2005/0173997 | A1 | 8/2005 | Schmid et al. | |
| 2005/0276684 | A1 | 12/2005 | Huang et al. | |
| 2005/0281672 | A1 | 12/2005 | Parker et al. | |
| 2006/0172682 | A1 | 8/2006 | Orr et al. | |
| 2006/0199515 | A1 | 9/2006 | Lasko et al. | |
| 2007/0035189 | A1 | 2/2007 | Matsumoto | |
| 2007/0041857 | A1 | 2/2007 | Fleig | |
| 2007/0048159 | A1 | 3/2007 | DiMatteo et al. | |
| 2007/0059179 | A1* | 3/2007 | Xu | F04D 29/284 416/182 |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0304986 | A1 | 12/2008 | Kenyon et al. | |
| 2008/0314250 | A1 | 12/2008 | Cowie et al. | |
| 2009/0026850 | A1 | 1/2009 | Fu | |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0191054 | A1 | 7/2009 | Winkler | |
| 2009/0214341 | A1 | 8/2009 | Craig | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0189557 | A1* | 7/2010 | Broom | F04D 29/30 415/203 |
| 2010/0219013 | A1 | 9/2010 | Liddell | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1* | 9/2010 | Dyson | F04F 5/16 415/90 |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0002775 | A1 | 1/2011 | Ma et al. | |
| 2011/0058935 | A1 | 3/2011 | Gammack et al. | |
| 2011/0097194 | A1 | 4/2011 | Schick et al. | |
| 2011/0110805 | A1 | 5/2011 | Gammack et al. | |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0114513 | A1 | 5/2012 | Simmonds et al. | |
| 2012/0230658 | A1 | 9/2012 | Fitton et al. | |
| 2013/0011252 | A1 | 1/2013 | Crawford et al. | |
| 2013/0045084 | A1 | 2/2013 | Tu et al. | |
| 2013/0189083 | A1 | 7/2013 | Atkinson | |
| 2013/0309065 | A1 | 11/2013 | Johnson et al. | |
| 2013/0309066 | A1 | 11/2013 | Atkinson et al. | |
| 2013/0309080 | A1 | 11/2013 | Johnson et al. | |
| 2013/0323025 | A1 | 12/2013 | Crawford et al. | |
| 2014/0017069 | A1 | 1/2014 | Peters | |

FOREIGN PATENT DOCUMENTS

| | | |
|---|---|---|
| CA | 1055344 | 5/1979 |
| CA | 2155482 | 9/1996 |
| CH | 346643 | 5/1960 |
| CN | 2085866 | 10/1991 |
| CN | 2111392 | 7/1992 |
| CN | 2228996 | 6/1996 |
| CN | 1232143 | 10/1999 |
| CN | 1288506 | 3/2001 |
| CN | 1336482 | 2/2002 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 101046318 | 10/2007 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 101816534 | 9/2010 |
| CN | 101825095 | 9/2010 |
| CN | 101825102 | 9/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102305220 | 1/2012 |
| CN | 102367813 | 3/2012 |
| CN | 202165330 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| DE | 10 2009 044 349 | 5/2011 |
| EP | 0 044 494 | 1/1982 |

(56) References Cited

FOREIGN PATENT DOCUMENTS

| | | |
|---|---|---|
| EP | 0186581 | 7/1986 |
| EP | 0 837 245 | 4/1998 |
| EP | 0 955 469 | 11/1999 |
| EP | 1 094 224 | 4/2001 |
| EP | 1 138 954 | 10/2001 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1387334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 490 | 3/2009 |
| GB | 2 452 593 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-51608 | 5/1978 |
| JP | 53-60100 | 5/1978 |
| JP | 56-167897 | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-211400 | 8/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 9-100800 | 4/1997 |
| JP | 9-287600 | 11/1997 |
| JP | 10-122188 | 5/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-140796 | 5/2001 |
| JP | 2001-295785 | 10/2001 |
| JP | 2002-21797 | 1/2002 |
| JP | 2002-138829 | 5/2002 |
| JP | 2002-213388 | 7/2002 |
| JP | 2002-371998 | 12/2002 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-92697 | 4/2007 |
| JP | 2007-138763 | 6/2007 |
| JP | 2007-138789 | 6/2007 |
| JP | 2008-39316 | 2/2008 |
| JP | 2008-100204 | 5/2008 |
| JP | 2008-151081 | 7/2008 |
| JP | 3146538 | 10/2008 |
| JP | 2008-294243 | 12/2008 |
| JP | 2009-44568 | 2/2009 |
| JP | 2009-264121 | 11/2009 |
| JP | 2010-131259 | 6/2010 |
| JP | 2012-36897 | 2/2012 |
| JP | 2012-57619 | 3/2012 |
| KR | 2002-0061691 | 7/2002 |
| KR | 2002-0067468 | 8/2002 |
| KR | 10-2005-0102317 | 10/2005 |
| KR | 2007-0007997 | 1/2007 |
| KR | 10-2010-0055611 | 5/2010 |
| KR | 2000-0032363 | 6/2010 |
| KR | 10-0985378 | 9/2010 |
| TW | M394383 | 12/2010 |

(56) References Cited

FOREIGN PATENT DOCUMENTS

| | | |
|---|---|---|
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100448 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/055134 | 5/2011 |

OTHER PUBLICATIONS

Atkinson et al., U.S. Office Action mailed Dec. 17, 2015, directed to U.S. Appl. No. 13/895,691; 11 pages.
Johnson et al., U.S. Office Action mailed Feb. 12, 2016, directed to U.S. Appl. No. 13/895,667; 13 pages.
Johnson et al., U.S. Office Action mailed Feb. 12, 2016, directed to U.S. Appl. No. 13/895,690; 14 pages.
Search Report dated Mar. 23, 2011, directed to GB Application No. 1020419.6; 1 page.
International Search Report and Written Opinion mailed Mar. 7, 2012, directed to International Application No. PCT/GB2011/052109; 12 pages.
Gammack, P. et al., U.S. Office Action mailed Dec. 9, 2010, directed to U.S. Appl. No. 12/203,698; 10 pages.
Gammack, P. et al., U.S. Office Action mailed Jun. 21, 2011, directed to U.S. Appl. No. 12/203,698; 11 pages.
Gammack et al., Office Action mailed Sep. 17, 2012, directed to U.S. Appl. No. 13/114,707; 12 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Nov. 29, 2012, directed to U.S. Appl. No. 12/716,742; 9 pages.
Cookson, M. et al., U.S. Office Action mailed Dec. 19, 2012, directed to U.S. Appl. No. 12/716,778; 8 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Atkinson et al., U.S. Office Action mailed Sep. 21, 2016, directed to U.S. Appl. No. 13/895,691; 10 pages.
Hodgson et al., U.S. Office Action mailed Mar. 24, 2014, directed to U.S. Appl. No. 13/207,212; 10 pages.

* cited by examiner

FAN

REFERENCE TO RELATED APPLICATIONS

This application is a national stage application under 35 USC 371 of International Application No. PCT/GB2011/052109, filed Oct. 28, 2011, which claims the priority of United Kingdom Application No. 1020419.6, filed Dec. 2, 2010, the entire contents of which are incorporated herein by reference.

FIELD OF THE INVENTION

The present invention relates to a fan for creating an air current in a room. Particularly, but not exclusively, the present invention relates to a floor or table-top fan, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

WO 2010/100448 describes a fan assembly which does not use caged blades to project air from the fan assembly. Instead, the fan assembly comprises a base which houses a motor-driven impeller for drawing a primary air flow into the base, and an annular nozzle connected to the base and comprising an annular slot through which the primary air flow is emitted from the fan. The nozzle defines a central opening through which air in the local environment of the fan assembly is drawn by the primary air flow emitted from the mouth, amplifying the primary air flow.

The impeller is in the form of a mixed flow impeller, which receives the primary air flow in an axial direction and emits the primary air flow in both axial and radial directions. The impeller comprises a generally conical hub and a plurality of blades connected to the hub. The impeller is located within an impeller housing mounted within the base of the fan. The leading edges of the blades of the impeller are located adjacent the air inlet of the impeller housing. The leading edges of the blades are rearwardly swept from the impeller hub to the blade tip. In other words, the leading edges of the blades extend rearwardly away from the air inlet of the impeller housing.

SUMMARY OF THE INVENTION

In a first aspect the present invention provides a fan for generating an air current within a room, the fan comprising a first casing comprising an air inlet through which an air flow is drawn into the fan, and a second casing connected to the first casing, the second casing comprising an air outlet from which the air flow is emitted from the fan, the first casing comprising an impeller housing having an air inlet and an air outlet, a mixed-flow impeller located within the impeller housing for drawing the air flow through the air inlet of the first casing, and a motor for driving the impeller, wherein the impeller comprises a substantially conical hub connected to the motor, and a plurality of blades connected to the hub, each blade comprising a leading edge located adjacent the air inlet of the impeller housing, a trailing edge, an inner side edge connected to and extending partially about the outer surface of the hub, an outer side edge located opposite to the inner side edge, and a blade tip located at the intersection of the leading edge and the outer side edge, and wherein the leading edge comprises an inner portion located adjacent the hub, and an outer portion located adjacent the blade tip, and wherein the inner portion is swept rearwardly from the hub to the outer portion, and the outer portion is swept forwardly from the inner portion to the blade tip.

The impeller differs from that described in WO 2010/100448 by way of the leading edge of each blade comprising an inner portion located adjacent the hub, and an outer portion located adjacent the blade tip. The inner portion is swept rearwardly from the hub to the outer portion, that is, away from the air inlet of the impeller housing, whereas the outer portion is swept forwardly from the inner portion to the blade tip, that is, towards the air inlet of the impeller housing.

This modification to the shape of the leading edge can reduce the noise generated during use of the fan in comparison to the impeller of WO 2010/100448. The localised forward sweep of the leading edge of each blade towards the blade tip can reduce the peak hub-to-tip loading of the blades, which peak is located generally at or towards the leading edges of the blades. Hub-to-tip loading is a method of analysing pressure gradients across the blade, and can be defined as:

$$\text{Hub-to-tip-loading} = \frac{W_t - W_h}{(W_t + W_h)\cdot 0.5}$$

where $W_t$ is the relative velocity of the flow at the blade tip and $W_h$ is the relative velocity of the flow at the hub. We have found that forward sweeping the leading edge of each blade can reduce the pressure gradient across the leading edge, reducing flow separation from the blade and thereby reducing noise associated with air turbulence.

However, a fully swept leading edge, that is, a leading edge which is swept forwardly from the hub to the blade tip, can increase blade-to-blade loading at the leading edge of the blade. Blade-to-blade loading is a method of analysing pressure gradients along the blade, and can be defined as:

$$\text{Blade-to-blade-loading} = \frac{W_{ss} - W_{ps}}{(W_{ss} + W_{ps})\cdot 0.5}$$

where $W_{ss}$ is the relative velocity of the flow at the suction side of the blade and $W_{ps}$ is the relative velocity of the flow at the pressure side of the blade. We have found that the blade-to-blade loading at the leading edge of the blade can be reduced by increasing the length of the inner side edge of the blade so that the length of the inner side edge approaches that of the outer side edge, resulting in the inner portion of the leading edge being swept rearwardly from the hub to the outer portion.

Preferably, the inner portion of the leading edge extends within a range from 30 to 80%, more preferably within a range from 50 to 70%, of the length of the leading edge.

The inner portion of the leading edge is preferably convex, whereas the outer portion of the leading edge is preferably concave. However, at least part of each portion of the leading edge may be straight. For example, the inner portion of the leading edge may be straight.

Blade-to-blade loading along the length of the blade may be optimised by controlling the lean angle of each blade, that is, the angle subtended between the blade and a plane extending radially outwardly from the hub. Each blade preferably has a lean angle which varies along the length of the blade. The lean angle preferably varies between a maximum value adjacent the leading edge of the blade, and a minimum value adjacent the trailing edge of the blade. The maximum value of the lean angle is preferably positive, that is, the blade leans forward in the direction of rotation of the impeller, whereas the minimum value of the lean angle is preferably negative, that is, the blade leans backward away from the direction of rotation of the impeller. The maximum value of the lean angle is preferably in the range from 15 to 30°, and the minimum value of the lean angle is preferably in the range from −20 to −30°. The lean angle is preferably at a value of 0° at or around a part of the blade which is midway between the leading edge and the trailing edge of the blade.

The width of the blade preferably decreases gradually from the leading edge to the trailing edge. The thickness of the blade preferably also varies between a maximum value and a minimum value. The minimum value of the thickness of the blade is preferably located at the trailing edge to optimise the aerodynamic performance of the blade. The maximum value of the thickness of the blade is preferably located midway between the leading edge and the trailing edge, and this maximum value is preferably in the range from 0.9 to 1.1 mm. The trailing edge is preferably straight.

Each blade preferably extends about the hub by an angle in the range from 60 to 120°.

The number of blades is preferably in the range from six to twelve.

To increase the stiffness of the impeller, the impeller may comprise a generally frusto-conical shroud connected to the outer side edge of each blade so as to surround the hub and the blades. The provision of the shroud also prevents the blade tips from coming into contact with the impeller housing in the event that the impeller becomes mis-aligned with the impeller housing during use.

The second casing preferably extends about an opening through which air from outside the second casing is drawn by the air flow emitted from the mouth. Preferably, the second casing surrounds the opening. The second casing may be an annular second casing which preferably has a height in the range from 200 to 600 mm, more preferably in the range from 250 to 500 mm.

Preferably, the mouth of the second casing extends about the opening, and is preferably annular. The second casing may comprise an inner casing section and an outer casing section which define the mouth of the second casing. Each section is preferably formed from a respective annular member, but each section may be provided by a plurality of members connected together or otherwise assembled to form that section. The outer casing section may be shaped so as to partially overlap the inner casing section. This can enable an outlet of the mouth to be defined between overlapping portions of the external surface of the inner casing section and the internal surface of the outer casing section of the second casing.

The outlet is preferably in the form of a slot, preferably having a width in the range from 0.5 to 5 mm, more preferably in the range from 0.5 to 2 mm. The second casing may comprise a plurality of spacers for urging apart the overlapping portions of the inner casing section and the outer casing section of the second casing. This can assist in maintaining a substantially uniform outlet width about the opening. The spacers are preferably evenly spaced along the outlet.

The second casing preferably comprises an interior passage for receiving the air flow from the stand. The interior passage is preferably annular, and is preferably shaped to divide the air flow into two air streams which flow in opposite directions around the opening. The interior passage is preferably also defined by the inner casing section and the outer casing section of the second casing.

The second casing may comprise a surface, preferably a Coanda surface, located adjacent the mouth and over which the mouth is arranged to direct the air flow emitted therefrom. Preferably, the external surface of the inner casing section of the second casing is shaped to define the Coanda surface. The Coanda surface preferably extends about the opening. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

Preferably, an air flow enters the second casing of the fan assembly from the first casing. In the following description this air flow will be referred to as primary air flow. The primary air flow is emitted from the mouth of the second casing and preferably passes over a Coanda surface. The primary air flow entrains air surrounding the mouth of the second casing, which acts as an air amplifier to supply both the primary air flow and the entrained air to the user. The entrained air will be referred to here as a secondary air flow. The secondary air flow is drawn from the room space, region or external environment surrounding the mouth of the second casing and, by displacement, from other regions around the fan assembly, and passes predominantly through the opening defined by the second casing. The primary air flow directed over the Coanda surface combined with the entrained secondary air flow equates to a total air flow emitted or projected forward from the opening defined by the second casing. Preferably, the entrainment of air surrounding the mouth of the second casing is such that the primary air flow is amplified by at least five times, more preferably by at least ten times, while a smooth overall output is maintained.

Preferably, the second casing comprises a diffuser surface located downstream of the Coanda surface. The external surface of the inner casing section of the second casing is preferably shaped to define the diffuser surface.

The impeller may be provided in isolation from the remaining features of the fan, for example for replacement of an existing impeller, and so in a second aspect the present invention provides an impeller, preferably for a fan, comprising a substantially conical hub, and a plurality of blades connected to the hub, each blade comprising a leading edge, a trailing edge, an inner side edge connected to and extending partially about the outer surface of the hub, an outer side edge located opposite to the inner side edge, and a blade tip located at the intersection of the leading edge and the outer side edge, and wherein the leading edge comprises an inner portion located adjacent the hub, and an outer portion located adjacent the blade tip, and wherein the inner portion is swept rearwardly from the hub to the outer portion, and the outer portion is swept forwardly from the inner portion to the blade tip.

Features described above in connection with the first aspect of the invention are equally applicable to the second aspect of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
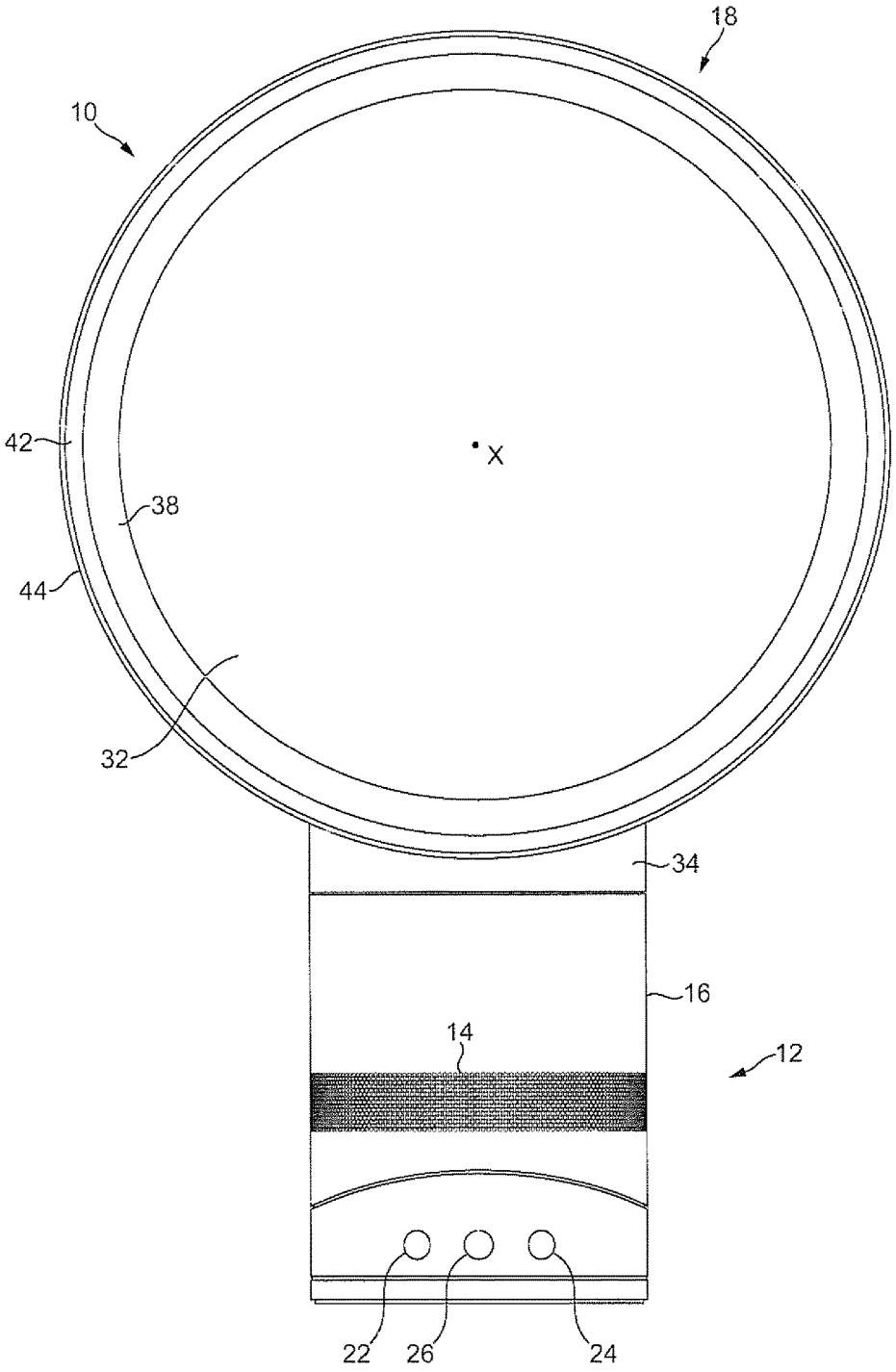
FIG. 1 is a front view of a fan.

FIG. 1 is a front view of a fan 10. The fan comprises a lower casing which in this example is in the form of a body 12 having an air inlet 14 in the form of a plurality of apertures formed in the outer surface 16 of the body 12, and through which a primary air flow is drawn into the body 12 from the external environment. An upper, annular casing 18 having an air outlet 20 for emitting the primary air flow from the fan 10 is connected to the body 12. The body 12 further comprises a user interface for allowing a user to control the operation of the fan 10. The user interface comprises a plurality of user-operable buttons 22, 24 and a user-operable dial 26.

Figure 2:
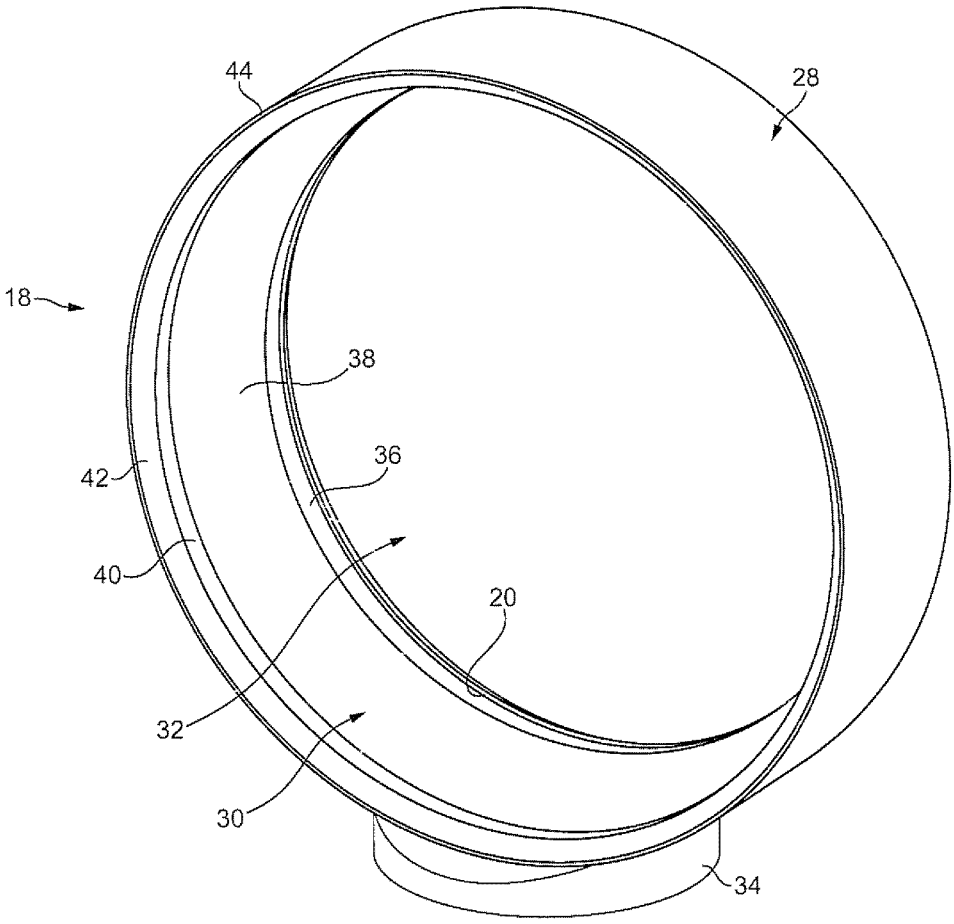
FIG. 2 is a front perspective view, from above, of the upper casing of the fan.
Figure 3:
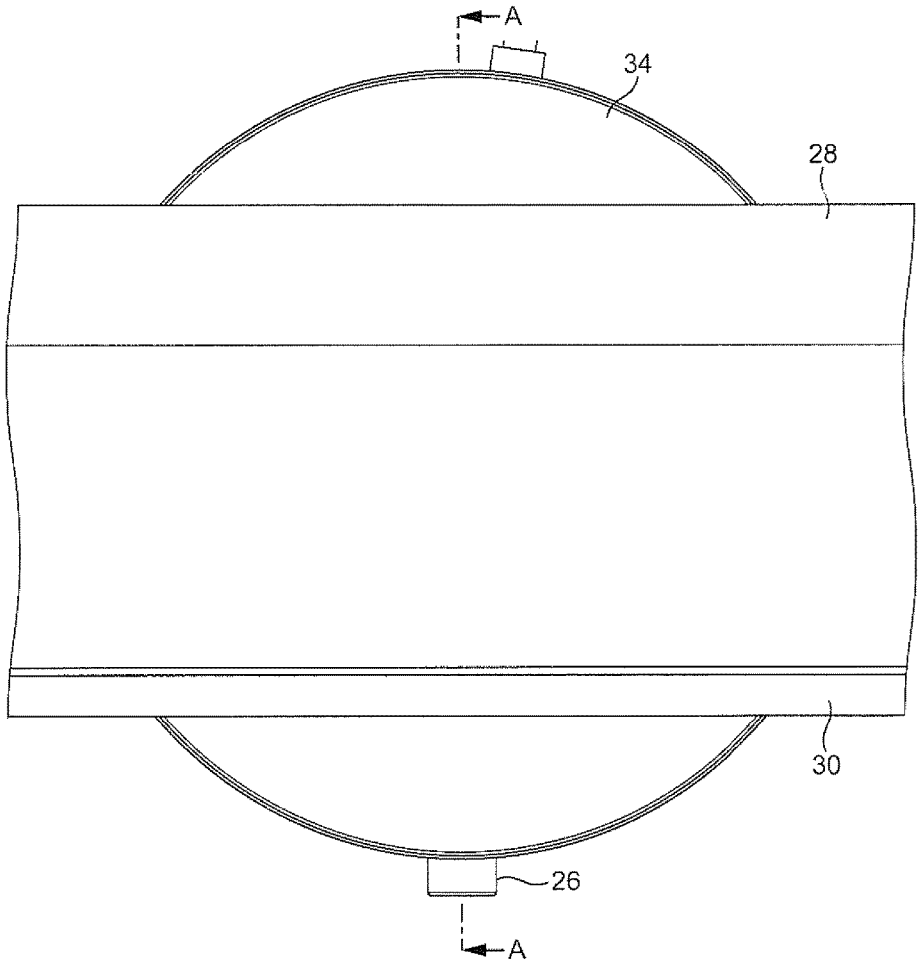
FIG. 3 is a top view of the fan.

As also shown in FIG. 2, the upper casing 18 comprises an annular outer casing section 28 connected to and extending about an annular inner casing section 30. The annular sections 28, 30 of the upper casing 18 extend about and define an opening 32. Each of these sections may be formed from a plurality of connected parts, but in this embodiment each of the outer casing section 28 and the inner casing section 30 is formed from a respective, single moulded part. During assembly, the outer casing section 28 is inserted into a slot located at the front of the inner casing section 30. The outer and inner casing sections 28, 30 may be connected together using an adhesive introduced to the slot. The outer casing section 28 comprises a base 34 which is connected to the open upper end of the body 12, and which has an open lower end for receiving the primary air flow from the body 12.

The outer casing section 28 and the inner casing section 30 together define an annular interior passage 35 (shown in FIG. 4) for conveying the primary air flow to the air outlet 20. The interior passage 35 is bounded by the internal surface of the outer casing section 28 and the internal surface of the inner casing section 30. The base 34 of the outer casing section 28 is shaped to convey the primary air flow into the interior passage 35 of the upper casing 18.

The air outlet 20 is located towards the rear of the upper casing 18, and is arranged to emit the primary air flow towards the front of the fan 10, through the opening 32. The air outlet 20 extends at least partially about the opening 32, and preferably surrounds the opening 32. The air outlet 20 is defined by overlapping, or facing, portions of the internal surface of the outer casing section 28 and the external surface of the inner casing section 30, respectively, and is in the form of an annular slot, preferably having a relatively constant width in the range from 0.5 to 5 mm. In this example the air outlet has a width of around 1 mm. Spacers may be spaced about the air outlet 20 for urging apart the overlapping portions of the outer casing section 28 and the inner casing section 30 to maintain the width of the air outlet 20 at the desired level. These spacers may be integral with either the outer casing section 28 or the inner casing section 30.

The air outlet 20 is shaped to direct the primary air flow over the external surface of the inner casing section 30. The external surface of the inner casing section 30 comprises a Coanda surface 36 located adjacent the air outlet 20 and over which the air outlet 20 directs the air emitted from the fan 10, a diffuser surface 38 located downstream of the Coanda surface 36 and a guide surface 40 located downstream of the diffuser surface 38. The diffuser surface 38 is arranged to taper away from the central axis X of the opening 32 in such a way so as to assist the flow of air emitted from the fan 10. The angle subtended between the diffuser surface 38 and the central axis X of the opening 32 is in the range from 5 to 25°, and in this example is around 15°. The guide surface 40 is angled inwardly relative to the diffuser surface 38 to channel the air flow back towards the central axis X. The guide surface 40 is preferably arranged substantially parallel to the central axis X of the opening 32 to present a substantially flat and substantially smooth face to the air flow emitted from the air outlet 20. A visually appealing tapered surface 42 is located downstream from the guide surface 40, terminating at a tip surface 44 lying substantially perpendicular to the central axis X of the opening 32. The angle subtended between the tapered surface 42 and the central axis X of the opening 32 is preferably around 45°.

Figure 4:
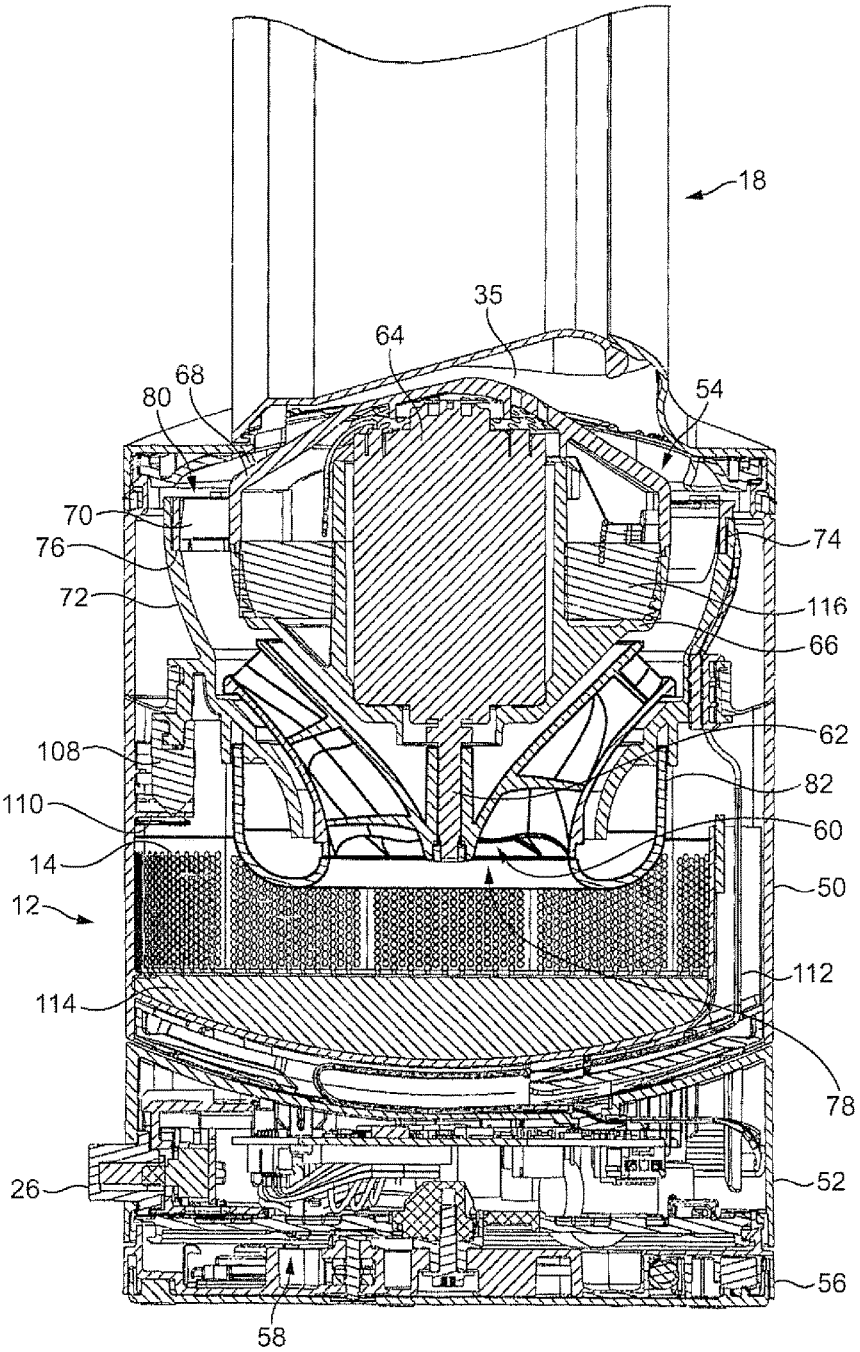
FIG. 4 is a side sectional view of the lower casing of the fan, taken along line A-A in FIG. 3.

FIG. 4 illustrates a side sectional view through the body 12 of the fan 10. The body 12 comprises a substantially cylindrical main body section 50 mounted on a substantially cylindrical lower body section 52. The main body section 50 and the lower body section 52 are preferably formed from plastics material. The main body section 50 and the lower body section 52 preferably have substantially the same external diameter so that the external surface of the upper body section 50 is substantially flush with the external surface of the lower body section 52.

The main body section 50 comprises the air inlet 14 through which the primary air flow enters the fan assembly 10. In this embodiment the air inlet 14 comprises an array of apertures formed in the main body section 50. Alternatively, the air inlet 14 may comprise one or more grilles or meshes mounted within windows formed in the main body section 50. The main body section 50 is open at the upper end (as illustrated) thereof to provide an air outlet 54 through which the primary air flow is exhausted from the body 12.

The main body section 50 may be tilted relative to the lower body section 52 to adjust the direction in which the primary air flow is emitted from the fan assembly 10. For example, the upper surface of the lower body section 52 and the lower surface of the main body section 50 may be provided with interconnecting features which allow the main body section 50 to move relative to the lower body section 52 while preventing the main body section 50 from being lifted from the lower body section 52. For example, the lower body section 52 and the main body section 50 may comprise interlocking L-shaped members.

The lower body section 52 is mounted on a base 56 for engaging a surface on which the fan assembly 10 is located. The lower body section 52 comprises the aforementioned user interface and a control circuit, indicated generally at 58, for controlling various functions of the fan 10 in response to operation of the user interface. The lower body section 52 also houses a mechanism for oscillating the lower body section 52 relative to the base 56. The operation of the oscillation mechanism is controlled by the control circuit 58 in response to the user's depression of the button 24 of the user interface. The range of each oscillation cycle of the lower body section 52 relative to the base 56 is preferably between 60° and 120°, and the oscillation mechanism is arranged to perform around 3 to 5 oscillation cycles per minute. A mains power cable (not shown) for supplying electrical power to the fan 10 extends through an aperture formed in the base 56.

The main body section 50 houses an impeller 60 for drawing the primary air flow through the air inlet 14 and into the body 12. The impeller 60 is a mixed flow impeller. The impeller 60 is connected to a rotary shaft 62 extending outwardly from a motor 64. In this embodiment, the motor 64 is a DC brushless motor having a speed which is variable by the control circuit 58 in response to user manipulation of the dial 26. The maximum speed of the motor 64 is preferably in the range from 5,000 to 10,000 rpm.

Figure 5:
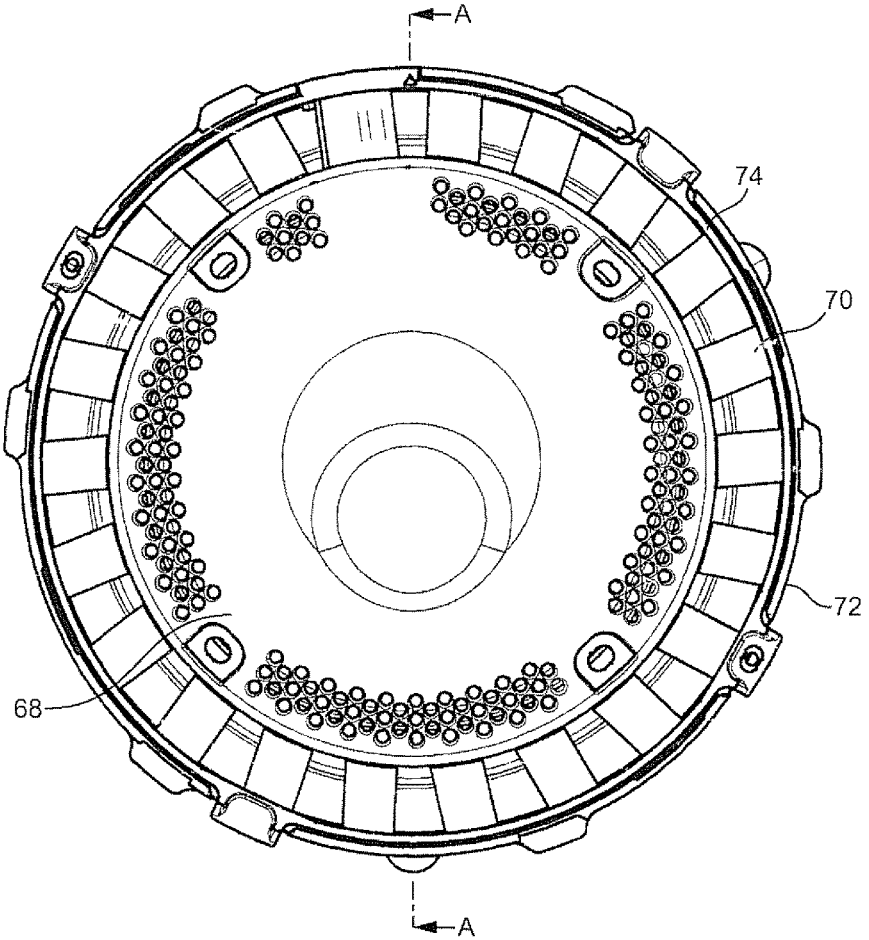
FIG. 5 is a top view of the impeller housing and motor housing of the lower casing.
Figure 6:
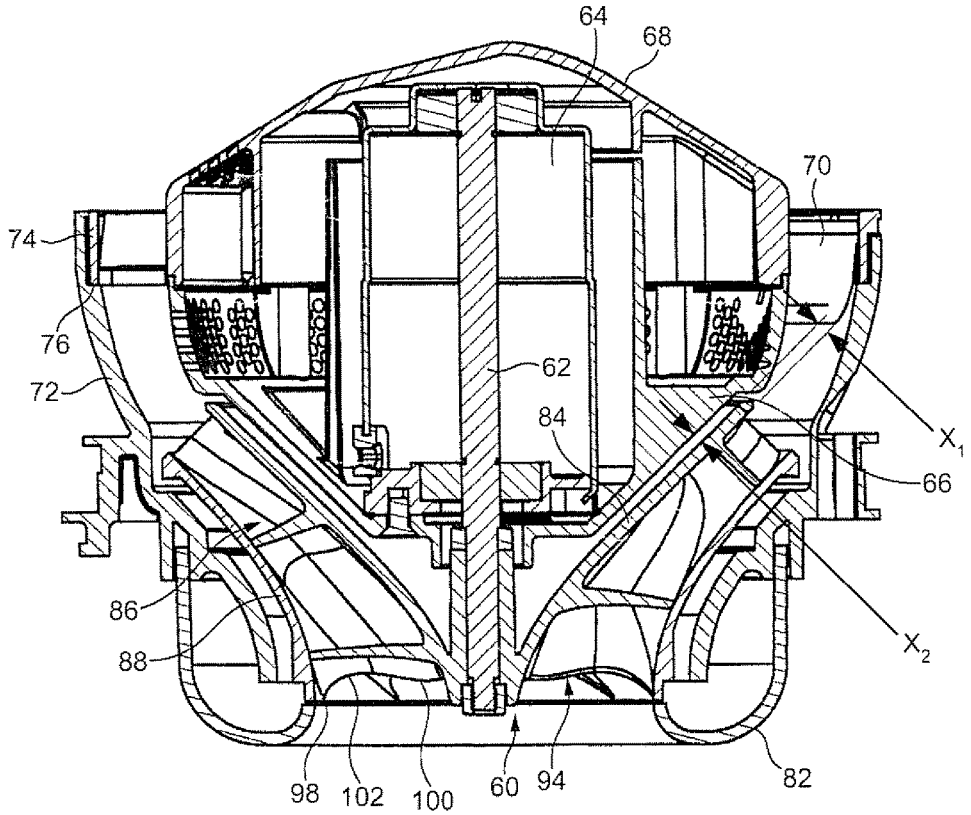
FIG. 6 is a side sectional view taken along line A-A in FIG. 5.
Figure 7:
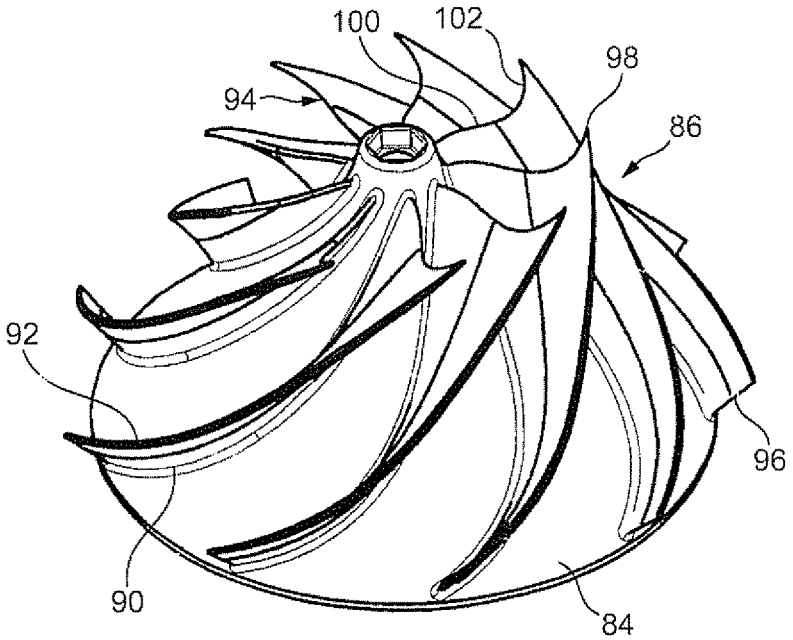
FIG. 7 is a front perspective view, from above, of the hub and blades of the impeller of the lower casing of the fan.
Figure 8:
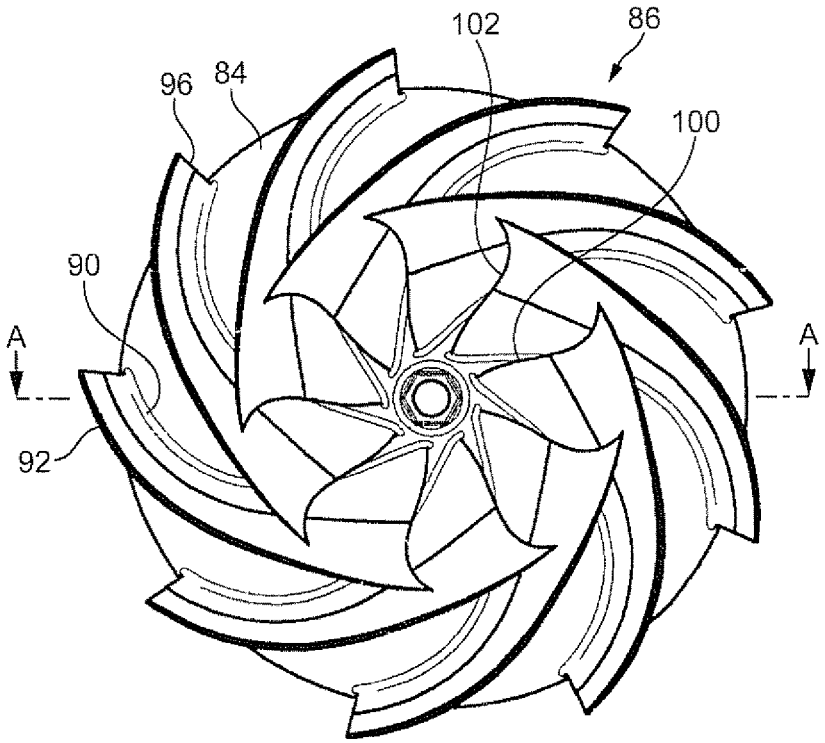
FIG. 8 is a top view of the hub and blades of the impeller.

With reference also to FIGS. 5 and 6, the motor 64 is housed within a motor housing. The motor housing comprises a lower section 66 which supports the motor 64, and an upper section 68 connected to the lower section 66. The shaft 62 protrudes through an aperture formed in the lower section 66 of the motor housing to allow the impeller 60 to be connected to the shaft 62. The upper section 68 of the motor housing comprises an annular diffuser 70 having a plurality of blades for receiving the primary air flow exhausted from the impeller 64 and for guiding the air flow to the air outlet 54 of the main body section 50.

The motor housing is supported within the main body section 50 by an impeller housing 72. The diffuser 70 comprises an outer annular member 74 which extends about the blades of the diffuser 70, and which is integral with the upper section 68 of the motor housing. The annular member 74 is supported by an annular support surface 76 located on an inner surface of the impeller housing 72.

The impeller housing 72 is generally frusto-conical in shape, and comprises a circular air inlet 78 at the relatively small, lower end thereof (as illustrated) for receiving the primary air flow, and an annular air outlet 80 at the relatively large, upper end thereof (as illustrated), and within which the diffuser 70 is located when the motor housing is supported within the impeller housing 72. An annular inlet member 82 is connected to the outer surface of the impeller housing 72 for guiding the primary air flow towards the air inlet 78 of the impeller housing 72.

The impeller 60 comprises a generally conical hub 84, a plurality of impeller blades 86 connected to the hub 84, and a generally frusto-conical shroud 88 connected to the blades 86 so as to surround the hub 84 and the blades 86. The blades 86 are preferably integral with the hub 84, which is preferably formed from plastics material. The thickness $x_1$ of the hub 84 is in the range from 1 to 3 mm. The hub 84 has a conical inner surface which has a similar shape to that of the outer surface of the lower section 66 of the motor housing. The hub 84 is spaced from the motor housing by a distance $x_2$ which is also in the range from 1 to 3 mm.

The hub 84 and the blades 86 of the impeller 60 are illustrated in more detail in FIGS. 7 to 11. In this example the impeller 60 comprises nine blades 86. Each blade 86 extends partially about the hub 84 by an angle in the range from 60 to 120°, and in this example each blade 86 extends about the hub 84 by an angle of around 105°. Each blade 86 has an inner side edge 90 which is connected to the hub 84, and an outer side edge 92 located opposite to the inner side edge 90. Each blade 86 also has a leading edge 94 located adjacent the air inlet 78 of the impeller housing 72, a trailing edge 96 located at the opposite end of the blade 86 to the leading edge 90, and a blade tip 98 located at the intersection of the leading edge 94 and the outer side edge 92.

The length of each side edge 90, 92 is greater than the lengths of the leading edge 94 and the trailing edge 96. The length of the outer side edge 92 is preferably in the range from 70 to 90 mm, and in this example is around 80 mm. The length of the leading edge 94 is preferably in the range from 15 to 30 mm, and in this example is around 20 mm. The length of the trailing edge 96 is preferably in the range from 5 to 15 mm, and in this example is around 10 mm. The width of the blade 86 decreases gradually from the leading edge 94 to the trailing edge 96.

The trailing edge 96 of each blade 86 is preferably straight. The leading edge 94 of each blade 86 comprises an inner portion 100 located adjacent the hub 84, and an outer portion 102 located adjacent the blade tip 98. The inner portion 100 of the leading edge 94 extends within a range from 30 to 80% of the length of the leading edge 94. In this example the inner portion 100 is longer than the outer portion 102, extending within a range from 50 to 70% of the length of the leading edge 94.

The shape of the blades 86 is designed to minimise noise generated during the rotation of the impeller 64 by reducing pressure gradients across parts of the blades 86. The reduction of these pressure gradients can reduce the tendency for the primary air flow to separate from the blades 86, and thus reduce turbulence within the air flow.

The outer portion 102 of the leading edge 94 is swept forwardly from the inner portion 100 to the blade tip 98. This localised forward sweep of the leading edge 94 of each blade 86 towards the blade tip 98 can reduce the peak hub-to-tip loading of the blades 86. The outer portion 102 is concave in shape, curving forwardly from the inner portion 100 to the blade tip 98. To reduce blade-to-blade loading of the blades 86, the inner portion 100 is swept rearwardly from the hub 86 to the outer portion 102 so that the length of the inner side edge 90 approaches that of the outer side edge 92. In this example the inner portion 100 of the leading edge 94 is convex in shape, curving rearwardly from the hub 84 to the outer portion 102 of the leading edge 94 to maximise the length of the inner side edge 90.

Figure 9:
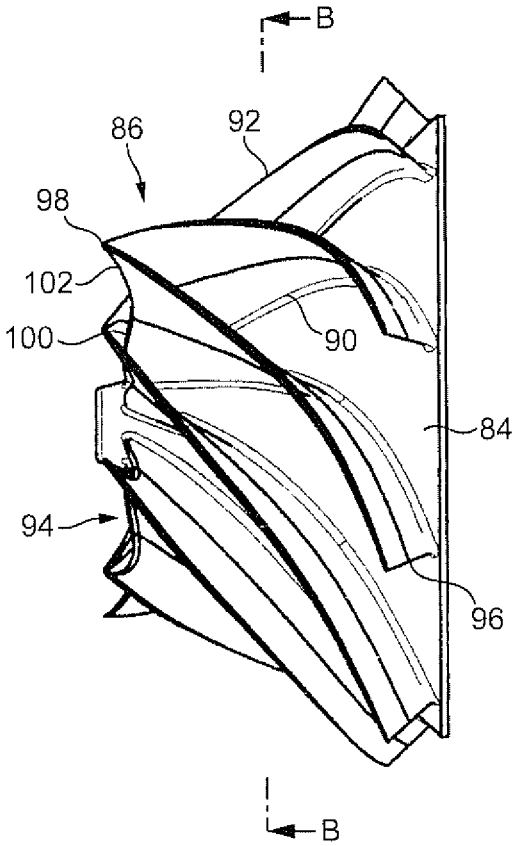
FIG. 9 is a side view of the hub and blades of the impeller.
Figure 10:
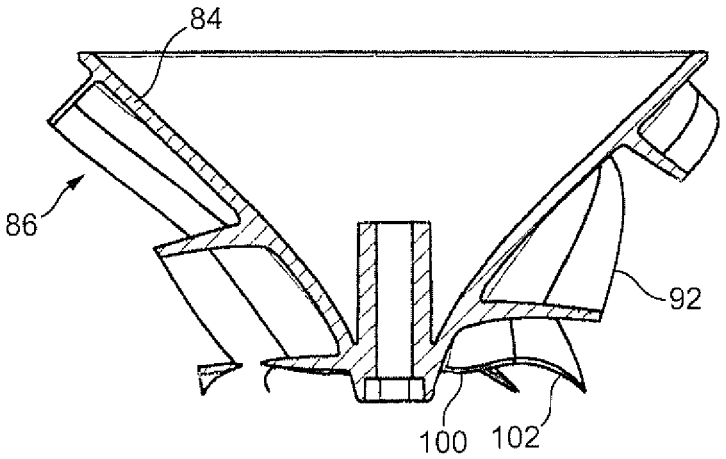
FIG. 10 is a side sectional view taken along line A-A in FIG. 8.
Figure 11:
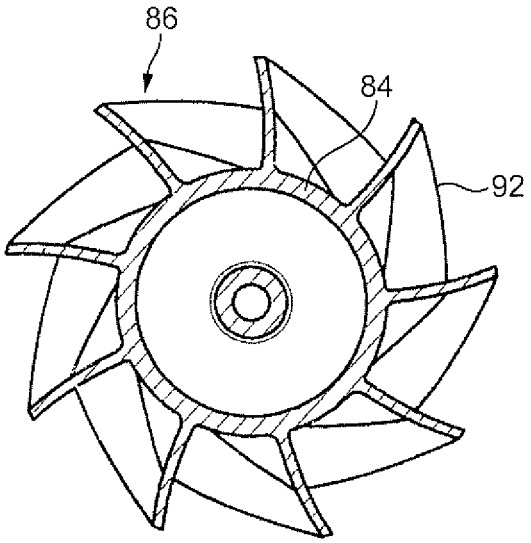
FIG. 11 is a top sectional view taken along line B-B in FIG. 9.

Blade-to-blade loading along the length of each blade 86 is reduced by controlling the lean angle of each blade 86, that is, the angle subtended between the blade 86 and a plane extending radially outwardly from the hub 84. Each blade 86 has a lean angle which varies along the length of the blade 86 from a maximum value adjacent the leading edge 94 of the blade 86 to a minimum value adjacent the trailing edge 96 of the blade 86. The lean angle is preferably positive at the leading edge 94 so that the blade 86 leans forward in the direction of rotation of the impeller 60 at the leading edge 94, whereas the lean angle is preferably negative at the trailing edge 96 so that the blade 86 leans backward away from the direction of rotation of the impeller 60. This is illustrated in FIG. 9. The maximum value of the lean angle is preferably in the range from 15 to 30°, and in this example is around 20°, and the minimum value of the lean angle is preferably in the range from −20 to −30°, and in this example is around −25°. The lean angle is at a value of 0° at or around a part of the blade 86 which is midway between the leading edge 94 and the trailing edge 96.

To minimise blade-to-blade loading at the trailing edge 96 of each blade 86, the thickness of the blade is preferably at a minimum value at the trailing edge 96. The maximum value of the thickness of the blade 86 is preferably located midway between the leading edge 94 and the trailing edge 96, and this maximum value is preferably in the range from 0.9 to 1.1 mm. In this example, this maximum value is around 1 mm. The minimum thickness is preferably in the range from 0.2 to 0.8 mm. The thickness of the blade 86 at the leading edge 94 is preferably between these maximum and minimum values. The variation in the thickness of the blades 86 along their length can be seen in FIG. 10.

Returning to FIG. 4, a plurality of rubber mounts 108 are connected to the impeller housing 72. These mounts 108 are located on a respective support 110 located within and connected to the main body section 50 of the base 12 when the impeller housing 72 is located within the base 12. An electrical cable 112 passes from the main control circuit 58 to the motor 64 through apertures formed in the main body section 50 and the lower body section 52 of the body 12, and in the impeller housing 72 and the motor bucket.

Preferably, the body 12 includes silencing foam for reducing noise emissions from the body 12. In this embodiment, the main body section 50 of the body 12 comprises a first foam member 114 located beneath the air inlet 14, and a second annular foam member 116 located within the motor bucket.

To operate the fan 10 the user presses button 22 of the user interface, in response to which the control circuit 58 activates the motor 64 to rotate the impeller 60. The rotation of the impeller 60 causes a primary air flow to be drawn into the body 12 through the air inlet 14. The user may control the speed of the motor 64, and therefore the rate at which air is drawn into the body 12 through the air inlet 14, by manipulating the dial 26. Depending on the speed of the motor 64, the primary air flow generated by the impeller 60 may be between 20 and 30 liters per second. The primary air flow passes sequentially through the impeller housing 72, and through the diffuser 70, before passing through the air outlet 54 of the body 12 and into the upper casing 18. The pressure of the primary air flow at the air outlet 54 of the body 12 may be at least 150 Pa, and is preferably in the range from 250 to 1.5 kPa.

Within the upper casing 18, the primary air flow is divided into two air streams which pass in opposite directions around the opening 32 of the casing 14. As the air streams pass through the interior passage 35, air is emitted through the air outlet 20. The primary air flow emitted from the air outlet 20 is directed over the Coanda surface 36 of the upper casing 18, causing a secondary air flow to be generated by the entrainment of air from the external environment, specifically from the region around the air outlet 20 and from around the rear of the upper casing 18. This secondary air flow passes through the central opening 32 of the upper casing 18, where it combines with the primary air flow to produce a total air flow, or air current, projected forward from the upper casing 18.

The invention claimed is:

1. A fan for generating an air current within a room, the fan comprising:

a first casing comprising an air inlet through which an air flow is drawn into the fan, and a second casing connected to the first casing, the second casing comprising an air outlet from which the air flow is emitted from the fan, the first casing comprising:

an impeller housing having an air inlet and an air outlet;

a mixed-flow impeller located within the impeller housing for drawing the air flow through the air inlet of the first casing; and a motor for driving the impeller;

wherein the impeller comprises a substantially conical hub connected to the motor, and a plurality of blades connected to the hub, each blade comprising a leading edge located adjacent the air inlet of the impeller housing, a trailing edge, an inner side edge connected to and extending partially about an outer surface of the hub, an outer side edge located opposite to the inner side edge, and a blade tip located at the intersection of the leading edge and the outer side edge;

and wherein the leading edge comprises an inner portion located adjacent the hub, and an outer portion located adjacent the blade tip, and wherein the inner portion is swept rearwardly from the hub to the outer portion away from a direction of rotation of the impeller, and the outer portion is swept forwardly from the inner portion to the blade tip toward the direction of rotation of the impeller.

2. The fan of claim 1, wherein the inner portion of the leading edge extends within a range from 30 to 80% of a length of the leading edge.

3. The fan of claim 1, wherein the inner portion of the leading edge extends within a range from 50 to 70% of a length of the leading edge.

4. The fan of claim 1, wherein the inner portion of the leading edge is convex.

5. The fan of claim 1, wherein the outer portion of the leading edge is concave.

6. The fan of claim 1, wherein each blade has a lean angle which varies along a length of the blade, wherein the lean angle is the angle subtended between the blade and a plane extending radially outwardly from the hub.

7. The fan of claim 6, wherein the lean angle varies between a maximum value adjacent the leading edge of the blade, and a minimum value adjacent the trailing edge of the blade.

8. The fan of claim 7, wherein the maximum value of the lean angle is in the range from 15 to 30°, and the minimum value of the lean angle is in the range from −20 to −30°.

9. The fan of claim 1, wherein a width of the blade decreases gradually from the leading edge to the trailing edge.

10. The fan of claim 1, wherein a thickness of the blade varies between a maximum value and a minimum value.

11. The fan of claim 10, wherein the minimum value of the thickness of the blade is at the trailing edge.

12. The fan of claim 10, wherein the maximum value of the thickness of the blade is located midway between the leading edge and the trailing edge.

13. The fan of claim 1, wherein the trailing edge is straight.

14. The fan of claim 1, wherein each blade extends about the hub by an angle in the range from 60 to 120°.

15. The fan of claim 1, wherein the number of blades is in the range from six to twelve.

16. The fan of claim 1, wherein the impeller comprises a generally frusto-conical shroud connected to the outer side edge of each blade so as to surround the hub and the blades.

* * * * *